United States Patent [19]

Drew

[11] 4,279,039

[45] Jul. 21, 1981

[54] SWIM CAP WITH INTEGRAL EYE PROTECTION

[75] Inventor: Daniel C. Drew, Jasper, Ind.

[73] Assignee: American Aquatic Concepts and Enterprises, Inc.; Jasper, Ind.

[21] Appl. No.: 51,860

[22] Filed: Jun. 25, 1979

[51] Int. Cl.[3] ..... A61F 9/02; A42B 1/12

[52] U.S. Cl. ..... 2/428; 2/68

[58] Field of Search ..... 2/68, 428, 429, 430, 2/10

[56] References Cited

U.S. PATENT DOCUMENTS

| | | | |
|---|---|---|---|
| 1,483,226 | 2/1924 | Johnson | 2/68 |
| 2,063,232 | 12/1936 | Davies | 2/68 |
| 2,568,316 | 9/1951 | Brown | 2/428 |
| 2,705,802 | 4/1955 | Tellier | 2/68 |
| 3,755,819 | 9/1973 | Douglas | 2/428 |
| 3,895,397 | 7/1975 | Douglas | 2/428 |

FOREIGN PATENT DOCUMENTS

| | | | |
|---|---|---|---|
| 2336096 | 7/1977 | France | 2/428 |

*Primary Examiner*—Peter P. Nerbun

*Attorney, Agent, or Firm*—Wilson, Fraser, Barker & Clemens

[57] ABSTRACT

An elastic swimmer's cap according to the instant invention includes integral eye protection. The eye protection comprises transparent or translucent lenses which are secured to the cap. Preferably, for reasons of improved comfort and water-tight seal, a separate lens is provided for each eye. An elastic strap is secured at each end to one of the protective lenses and encircles the rear periphery of the cap. The cap is retained on the swimmer's head by means of both the elasticity of the cap and the strap. The tension of the cap on the swimmer's head and maintenance of a water-tight seal about the lenses during all swimming and diving maneuvers is greatly improved by this dual protection means.

15 Claims, 4 Drawing Figures

SWIM CAP WITH INTEGRAL EYE PROTECTION

BACKGROUND OF THE INVENTION

The invention relates generally to swimmer's apparel and more specifically to a swimmer's elastic cap having integral eye protection, i.e., goggles. The utility and benefits of head and eye protection for swimmers are well known. An elastic swim cap retains a swimmer's hair away from his eyes and mouth, reduces friction by improving streamlining and is hygienically desirable. Eye protection such as goggles likewise offers several benefits such as reduced eye irritation from chlorine, greatly improved vision and increased concentration and confidence due to the elimination of this irritant. The utility of these devices and their attendant advantages are of even greater significance for competitive swimmers.

Unfortunately, the rigors of competitive swimming such as violent dives and rapic turns have created a novel set of problems which prior art goggles and caps have not solved.

The common problem with many prior art goggle designs is that they tend to dislodge when subjected to the impact of diving entry or violent lane turns. In an attempt to overcome this difficulty, the wearer may tuck in his chin which will result in a poor entry dive. Gains in visibility and confidence which the goggles confer thus may be lost by compensation the swimmer makes to retain the goggles upon his head.

The swimmer also soon learns that if such compensation for the goggles (to retain them upon his head) is not made, they will frequently dislodge. The swimmer then is forced to remove them and the removal operation will detract from the swimmer's stroke and consume precious time.

Elastic caps, too, are frequently used in competitive swimming sports. However, in spite of their tight fit upon the swimmer's head, they frequently become dislodged by the violent motions of competitive swimmers.

SUMMARY OF THE INVENTION

A swimmer's cap having integral eye protection means, namely, goggles, solves these problems of the prior art. In the preferred embodiment, the cap is fabricated of latex rubber and is somewhat larger than conventional swim caps in that it extends downward on the face of the wearer to below the eyes. The latex rubber is preferably chlorinated to remove the tack from the rubber and improve the ease with which the cap is placed upon the wearer's head. An opening in the latex rubber cap is provided for each eye and a translucent lens is positioned on the outer surface of the rubber cap about each opening. On the inner surface of the cap about each opening is a bead or gasket of foam material which functions as a water-tight seal to prevent water from entering the space between the wearer and the protective lens. The lens may include a thin reflective coating to lower the percent of light transmitted to the wearer's eye. Such a thin reflective layer may be applied to the lenses by techniques such as vapor deposition or other means known in the art. The lenses themselves are preferably fabricated of a high impact plastic such as polystyrene or Lexan. An adjustable clip interconnects the most proximate portions of the lenses. An elastic band which is attached to the most distant portions of the lenses circles the rear portion of the cap and greatly improves its retention characteristics. Cooperation between the rubber cap and the elastic strap is believed to be the reason for the greatly improved retention characteristics which this invention exhibits. Secondarily, by attaching the goggles to the cap, the force of water passing downward over the face during a dive is absorbed and transmitted through the region of the cap adjacent the wearer's forehead. This action, too, results in improved retention of the cap and goggles on the wearer's head.

Thus it is an object of the instant invention to provide a cap and goggles combination which exhibits greatly improved retention characteristics, especially important when worn during competitive swimming events.

It is a further object of the instant invention to provide a cap and goggles combination exhibiting an improved surface frictional characteristic which allows easy donning and removal.

It is a still further object of the instant invention to provide a combination cap and goggles exhibiting improved water-tight seal characteristics about the eye of the wearer.

Still further objects of the instant invention will become apparent by reference to the following specification and attached drawings.

DESCRIPTION OF THE PREFERRED EMBODIMENT

Figure 1:
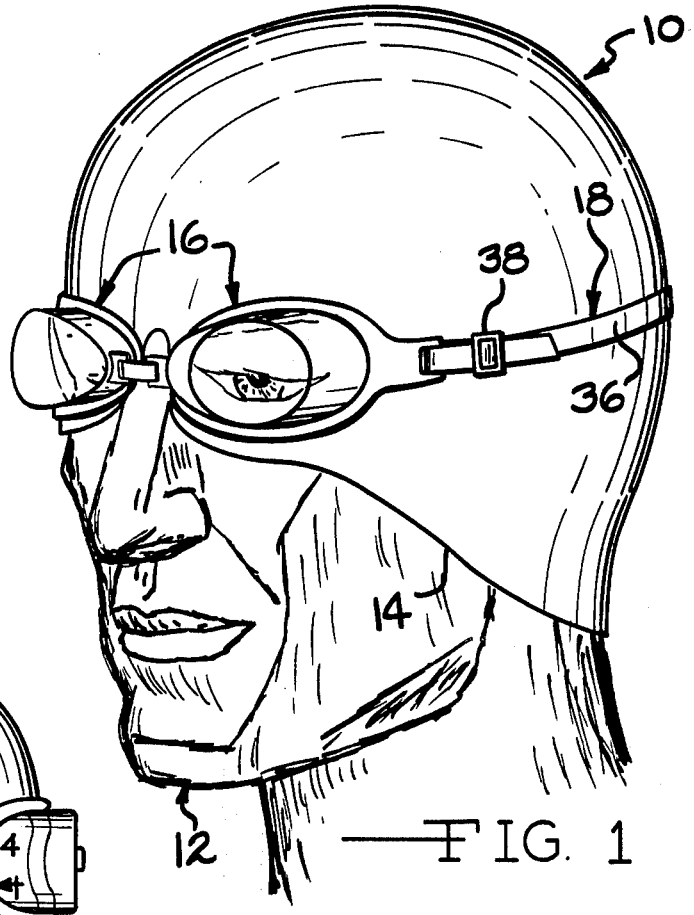
FIG. 1 is a perspective view of a swimmer with the combination cap and goggles of the instant invention in place on his head.

Referring now to FIG. 1, a swim cap with integral eye protection is illustrated in FIG. 1 and generally designated by the reference numeral 10. The cap 10 is molded of latex or similar rubber and preformed in a generally spherical shape to conform to the head of a swimmer 12. A lower marginal edge 14 of the swim cap 10 extends from the bridge of the swimmer's nose obliquely downwardly and rearwardly to a central region in the back of the swimmer's neck. The cap 10 includes integral goggle assemblies 16 and a strap assembly 18.

Figure 2:
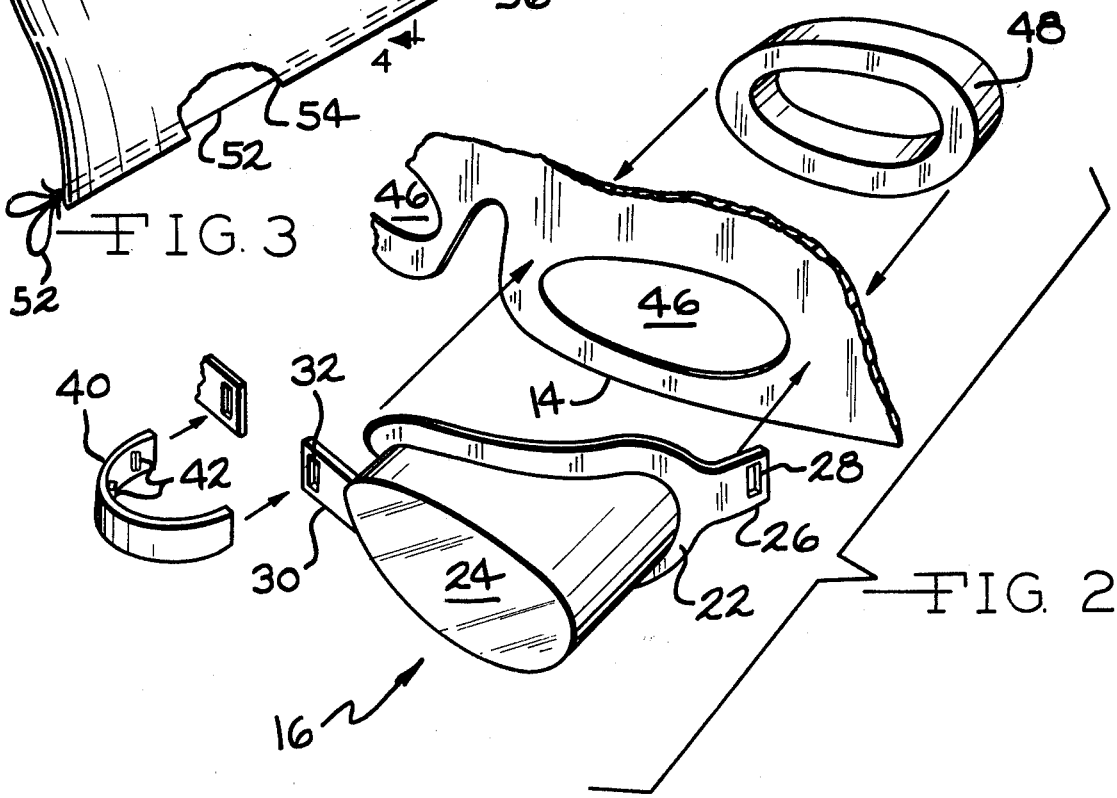
FIG. 2 is an exploded perspective view of the protective lens and seal.

Referring now to FIG. 2, one of the two goggle assemblies 16 is illustrated in an exploded perspective view and is seen to comprise a generally oval lens assembly 20 having a generally outwardly extending margin or lip 22 disposed about its periphery. The lens assembly 20 preferably includes a generally planar surface 24 but may define a semi-elliptical, semi-ovid or other surface configuration if desired. The lip 22 includes a rear tab 26 having a rectangular aperture 28 disposed therein. A front tab 30 is positioned adjacent the forward part of the lens 20 substantially diametrically opposite the rear tab 26 and also includes a rectangular aperture 32.

The left and right goggle assemblies 16 are preferably fabricated of a high impact transparent plastic such as polystyrene or Lexan by a plastic injection molding process or other suitable production means well known in the art. The goggle assemblies 16, as illustrated, are identical and, as such, are interchangable between left and right sides. If, however, especially accurate conformity to a wearer's head or a specific, possibly asymmetric, lens shape is desired, the goggle assemblies 15 may, of course, be individually and distinctly shaped to conform to such requirements. Alternatively, the goggle assemblies 16 may be fabricated as a unitary component of sufficient width to cover and protect both eyes of the user. Furthermore, the goggle assemblies 16 and specifically the lenses 20 may include an integral reflective surface to reduce light transmission to the eye. Details of such surfaces and processes for applying them are described below.

Figure 3:
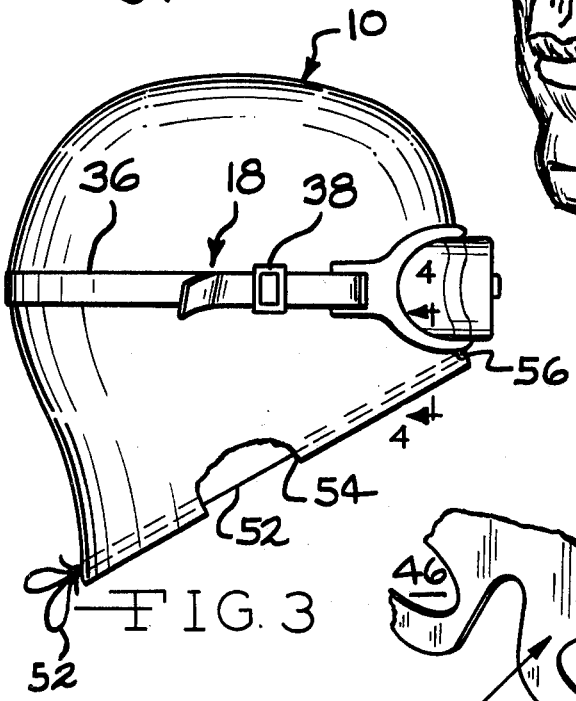
FIG. 3 is a side elevational view illustrating the goggle strap and an optional drawstring seal.

Referring now to FIGS. 2 and 3, the strap assembly 18 is seen to include a band 36 of elastic rubber or similar material which extends between the rear apertures 28 of each of the goggle assemblies 16 and is generally secured therein by a pair of adjustable, sliding buckles 38. The buckles 38 may be utilized in a conventional manner to adjust the relaxed length of the band 36 and thus its tension when placed about the head of a wearer. Interconnecting the proximate front tabs 30 of the goggle assemblies 16 is a flexible though relatively inextensible adjustment band 40. The width and thickness of the band 40 are such that it fits within the rectangular apertures 32 of the front tabs 30 of the goggle assemblies 16. On one or both surfaces of the band 40 and disposed transversely to the long axis of the band 40 are a plurality of protuberances or stops 42. The stops 42 engage the surface of the front tabs 30 adjacent the rectangular apertures 28 to maintain the two goggle assemblies 16 at a fixed distance apart but may be pushed through the apertures 32 due to the deformable nature of the material of which the band 40 is fabricated to provide adjustment of the separation between the goggle assemblies 16. If the alternate, unitary goggle construction described in the previous paragraph is utilized, the band 40 and associated components need not, of course, be used. It should be noted that all of the foregoing structures are positioned upon the outer surface of the swim cap 10.

Referring to FIG. 2, it should be apparent that the swim cap 10 includes a pair of symmetrically disposed oval apertures 46 disposed on the forward surface of the cap 10 adjacent the marginal edge 14. A complementarily shaped seal structure 48 is disposed about each of the apertures 46 on the inner surface of the cap 10. The seal structure 48 which is preferably fabricated of a closed cell rubber or polyurethane foam has a generally rectangular cross section and provides a water-tight seal between the inner surface of the cap 10 and the region about the eyes of the swimmer 12.

Figure 4:
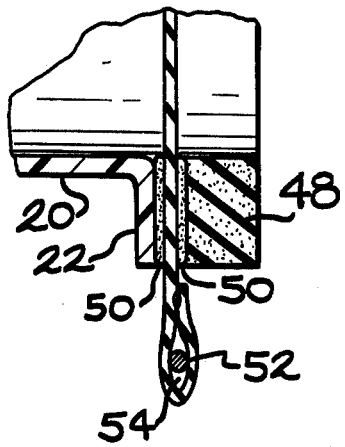
FIG. 4 is an enlarged, fragmentary sectional view of the protective lens and cap taken along line 4—4 of FIG. 3.

Referring now to FIGS. 3 and 4, the construction of the cap 10 about the goggle assemblies 16 may be clearly seen. The seal structure 48 is secured to the inner surface of the cap 10 by a thin layer of an appropriate gluing agent 50. Preferably, the gluing agent 50 slightly softens the material of the seal structure 48 and cap 10 to provide a suitable water-tight bond and also, in view of this application, remains somewhat flexible in order to improve its service life. On the outer face of the cap 10 is disposed a second layer of the gluing agent 50 which secures the goggle assemblies 16 and more specifically, the lip 22 thereof to the outer surface of the cap 10.

The cap 10 may also include a drawstring 52 which is generally disposed adjacent the marginal edge 14 of the cap 10 in a hem 54 formed by turning under the edge of the cap 10 and securing it to itself. The drawstring 52 is preferably fabricated of inelastic or elastic flexible cord and comprises two substantially equal lengths thereof secured symmetrically to the forwardmost central region of the cap 10 or the goggle assemblies 16 at a point generally designated by the numeral 56.

Production of the swim cap with integral eye protection utilizes a conventional aluminum, porcelain or stainless steel form (not illustrated), a structure which is well known in the rubber molding art. The form is first dipped in a coagulant and then into a latex rubber solution comprising approximately one-half rubber and one-half water. The rubber coating on the form is then allowed to dry and is next subjected to a temperature of 200° F.–250° F. to effect vulcanization of the rubber cap. The final step in the production of the rubber cap 10, proper, is the stripping of the cap from the form.

Trimming of the marginal edge 14 of the cap 10 and cutting of the oval apertures 46 for the goggle assemblies 16 may next be accomplished.

The tackiness of conventional rubber swim caps is a result of production by the process steps enumerated above. It has been found desirable to chlorinate the cap 10 to eliminate the tack of such latex rubber and improve both the retention characteristics of the cap 10 as well as the ease with which it is placed upon and removed from a swimmer's head. The chlorination process comprehends subjecting the rubber cap 10 to a chlorine water bath containing between 400 and 800 parts per million chlorine until the tack of the rubber surface is removed and the desired latex rubber characteristics are achieved.

If desired, the goggle assemblies 16, which as noted may be fabricated of a high strength plastic such as polystyrene or other suitable substantially transparent material, may include reflective or absorptive material within or on one surface of the goggle assemblies 16 to lessen light transmission to the eye of the swimmer. Materials and processes for lowering the light transmission of the goggle assemblies 16 by incorporating particulate matter or coloring agents thereinto is deemed to be well understood by those skilled in the art and will thus not be further described. It has been found possible, however, to provide a thin surface of a reflective, generally metallic, material on one surface of the goggle assemblies 16. Vapor deposition techniques may be utilized to provide a surface of nichrome or similar material of between 100 and 300 Angstrom units thick on the outer face of the goggle assmblies 16. The vapor deposition of the nichrome material is accomplished at a reduced pressure, typically $10^{-5}$ torr wherein a high energy electrical current is applied to a nichrome wire causing it to vaporize within the vacuum and deposit on adjacently positioned outer surfaces of the goggles 16. The length of the deposition process may be varied substantially but may be typically 5 to 10 minutes such that a light transmission factor of from 20% to 10% with approximately a 35% absorption factor and the remainder of light incident the goggle being reflected may be achieved.

The foregoing disclosure is the best mode devised by the inventor for practicing this invention. It is apparent, however, that devices incorporating modifications and variations to the instant invention will be obvious to one skilled in the art of swimmer's head gear. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What I claim is:

1. Swimming apparel comprising, in combination, a unitary elastic cap defining an inner surface and an outer surface and having a marginal edge, two goggle means secured to said cap for covering and protecting a swimmer's eyes, each of said goggle means defining a unitary lens assembly having a pair of means disposed adjacent said outer surface for securing straps thereto, a head strap secured between one of said strap securing means on each of said lens assemblies and disposed about a rearward portion of said outer surface of said cap, whereby said cap and said head strap cooperate to retain said apparel on the swimmer's head.

2. The swimming apparel of claim 1, further including a drawstring extending between a forward portion and a rearward portion of said cap and means for maintaining said drawstring generally adjacent said marginal edge.

3. The swimming apparel of claim 1 wherein said cap is fabricated of chlorinated rubber.

4. The swimming apparel of claim 1 wherein said goggle means includes means for partially inhibiting light transmission therethrough.

5. Protective apparel for a swimmer comprising, in combination an elastic cap having an inside surface, an outside surface, a forward portion and a rearward portion, said cap defining two apertures in said forward portion and having a lower marginal edge, a goggle means secured to said cap about each of said apertures for protecting such swimmer's eyes, said goggle means including a lens assembly and two generally diametrically opposed means disposed adjacent the outside surface of said cap for securing straps, a first strap secured between an adjacent pair of said strap securing means, one of said adjacent pair of said strap securing means disposed on one of said goggle means and the other one of said adjacent pair of said strap securing means disposed on the other of said goggle means and a second strap secured to between the remaining pair of strap securing means on said goggle means and disposed about said rearward portion and said outside surface of said cap.

6. The protective apparel of claim 5 further including a drawstring extending between said forward portion and said rearward portion on each side of said cap and means for maintaining said drawstring substantially adjacent said marginal edge and wherein said lower marginal edge extends below the ears and eyes of a person's head when appropriately positioned thereon.

7. The protective apparel of claim 5, further including gasket means disposed generally about the periphery of said apertures for providing a seal between said cap and such swimmer's head.

8. The protective apparel of claim 5 wherein said first strap and said goggle means include cooperating means for providing adjustment of the separation between said lens assemblies.

9. Swimmer's headgear comprising, in combination, an elastic cap having an inner surface, an outer surface, a forward portion and a rearward portion, said cap having a lower marginal edge extending below the eyes of such swimmer and defining two apertures in said forward portion, one unitary goggle assembly secured to said cap generally about each of said two apertures, said goggle assemblies each including a lens portion, at least a pair of generally diametrically opposed openings adjacent said outer surface of said cap and peripheral lip means for facilitating securement of said assemblies to said outer surface of said cap, a generally annular gasket means disposed about each of said apertures on said inner surface of said cap for providing a seal between said cap and such swimmer's head, an adjustable strap means secured at each end within said openings and extending around the rearward portion on said outer surface of said cap and an adjustable link means secured at each end within said openings for interconnecting the proximate portions of said two goggle assemblies.

10. The swimmer's headgear of claim 9 further including a drawstring extending from said forward portion to said rearward portion of said cap and means for maintaining said drawstring substantially adjacent said lower marginal edge of said cap.

11. The swimmer's headgear of claim 9 wherein said cap is fabricated of chlorinated rubber.

12. The swimmer's headgear of claim 9 wherein said goggle assemblies include means for partially inhibiting light transmission therethrough.

13. The swimming apparel of claim 1 wherein said pair of means for securing straps thereto are disposed in generally diametrically opposed relationship on said lens assembly and each defines a strap receiving aperture.

14. The swimming apparel of claim 1 further including a nose strap secured between the other of said strap securing means on each of said lens assemblies and disposed over the nose bridge of the swimmer's head.

15. The swimming apparel of claim 1 wherein said lens assembly further includes an outwardly extending peripheral lip, whereby said lens assemblies may be secured to said outer surface of said cap.

* * * * *